United States Patent [19]

Jenvey

[11] Patent Number: 5,058,336

[45] Date of Patent: Oct. 22, 1991

[54] HINGED FLANGE POLE

[75] Inventor: Alan J. Jenvey, Kirby in Ashfield, England

[73] Assignee: Abacus Holdings Ltd., Sutton in Ashfield, England

[21] Appl. No.: 190,696

[22] Filed: May 5, 1988

[30] Foreign Application Priority Data

Aug. 5, 1987 [GB] United Kingdom ..... 8710919
Sep. 30, 1987 [GB] United Kingdom ..... 8723005

[51] Int. Cl.[5] ..... E04H 12/34

[52] U.S. Cl. ..... 52/115; 52/116; 52/119

[58] Field of Search ..... 52/115, 116, 119, 120, 52/296; 182/2, 152; 248/158

[56] References Cited

U.S. PATENT DOCUMENTS 2,065,715 12/1935 Leon ..... 52/116 X
3,715,852 2/1973 Koga ..... 52/116 X
4,020,606 5/1977 Pratt ..... 52/116
4,079,559 3/1978 Tenbrummeler ..... 52/296 X

FOREIGN PATENT DOCUMENTS 1474803 3/1967 France .
2316413 1/1977 France .
241357 7/1979 France .
84/02372 6/1984 PCT Int'l Appl. ..... 52/296
335838 3/1959 Switzerland .
1212836 7/1980 United Kingdom .

*Primary Examiner*—Henry E. Raduazo
*Attorney, Agent, or Firm*—Spensley Horn Jubas & Lubitz

[57] ABSTRACT

A column is attached at a base flange to a plate of a base member by way of an offset horizontal pivot, and can be pivotally raised and lowered by means of a ram. The pivot lies in the general plane of the flange and the plate so that, when the column is fully lowered, the overall height of the unit in the region of the base member is little more than the length of the flange.

10 Claims, 3 Drawing Sheets

HINGED FLANGE POLE

This invention relates to a hinged flange pole (hereinafter "column unit") for mounting an appliance at an elevated location, such as a street lighting column.

According to the present invention, such a column unit comprises a normally upright column, a base member to which the column is attached by way of a generally horizontal pivot which is offset to one side of the column, a fluid operated device connected or connectible between the column and the base member for pivotally raising and lowering the column relative to the base member about the pivot, and locking means operable to lock the column relative to the base member in its upright position.

Desirably, the fluid operated device is disposed on the opposite side of the column to the pivot, and may comprise a ram which preferably extends as the column is pivotally lowered and contracts as the column is pivotally raised.

Preferably, the base member includes a plate, the column includes a base flange which lies against the plate when the column is in its upright position, and the pivot interconnects the plate and the base flange.

The locking means can comprise one or more securing elements which pass through holes in the plate and/or in the base flange.

Advantageously, the plate is disposed at or close to ground level and the pivot is disposed substantially in the plane of the plate, so that when the column is fully lowered the height of the overall unit in the region of the base member is not substantially greater than the length of the base flange.

Conveniently, the base member is provided with first mounting means to which a piston of the ram is connected or connectible, and the column is provided with second mounting means to which a cylinder of the ram is connected or connectible, the first and second mounting means being disposed at closely adjacent locations.

Desirably, the column unit further comprises a safety interlock which is operable to retain the column in its upright position after the locking means has been released and which is readily released to permit the column to be pivotally lowered. This interlock is preferably provided by a latch device which automatically re-engages as the column returns to its upright position.

The invention will now be further described, by way of example only, with reference to the accompanying drawings, in which.

Figure 1:
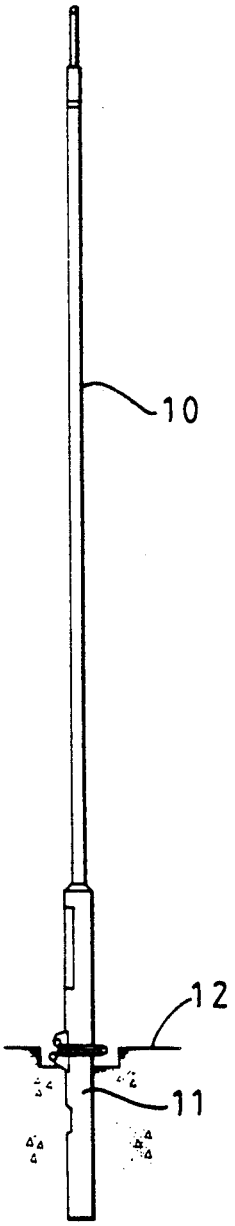
FIG. 1 is a general view of a column unit according to the present invention.
Figure 2:
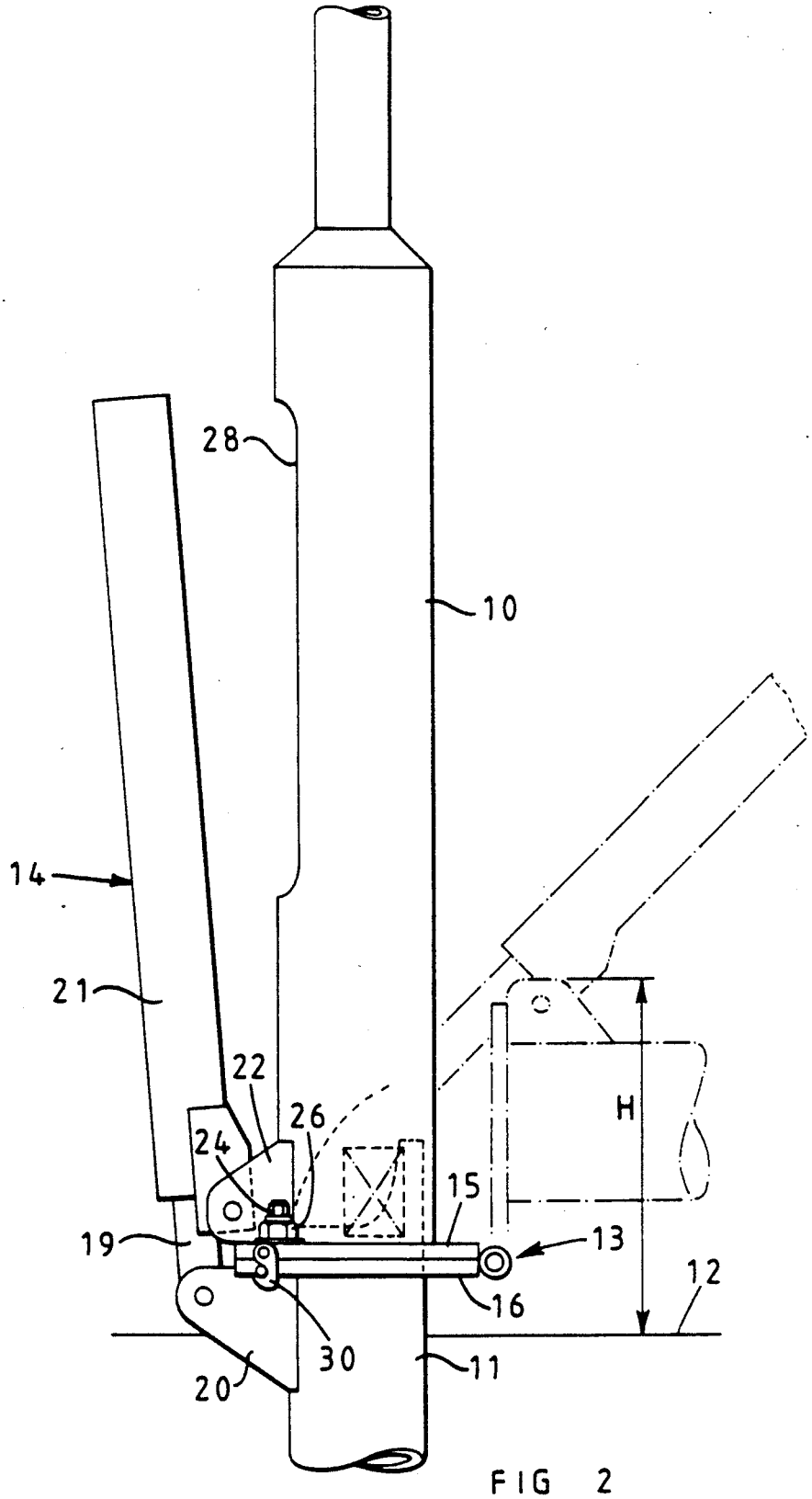
FIG. 2 is a side elevation of a lower part of the column unit shown in FIG. 1.

Referring first to FIGS. 1 and 2, the illustrated column unit comprises a hollow column 10 which normally occupies an upright position (as shown) and which at its upper end mounts an appliance (such as lighting) at an elevated location. For the sake of convenience, the appliance is not actually depicted in the drawings At its lower end, the column 10 is attached to a base member 11 which is anchored into the ground, ground level being indicated at 12. Such attachment is by means of a generally horizontal pivot 13 which allows the column 10 to be pivotally lowered in order to bring the appliance down to ground level, inter alia for servicing. As can be seen to advantage in FIG. 2, the pivot 13 is offset to one side of the column 10. Raising and lowering of the column is performed by means of a double-acting ram 14 which is disposed on the opposite side of the column 10 to the pivot 13.

Figure 6:
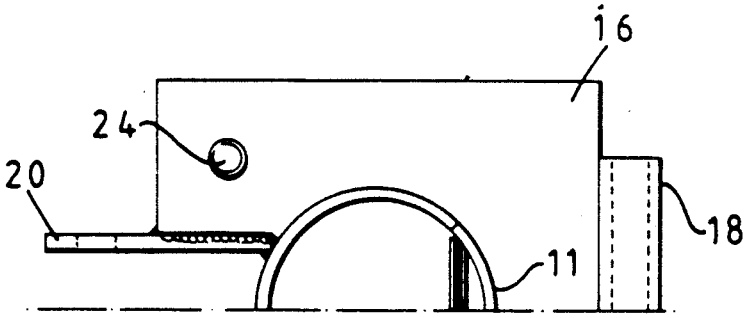
FIG. 6 is a view in the direction of arrow Y in FIG. 5.
Figure 3:
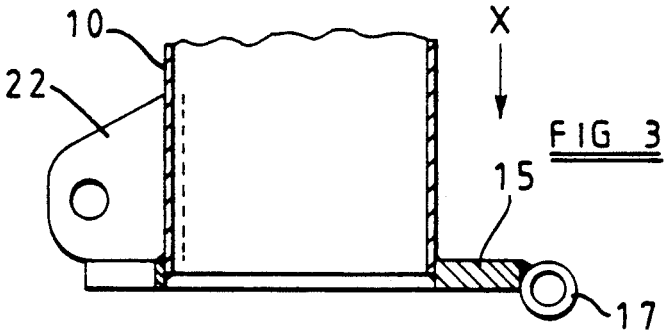
FIG. 3 is a sectional side view of a lower part of a column which forms part of the unit.
Figure 4:
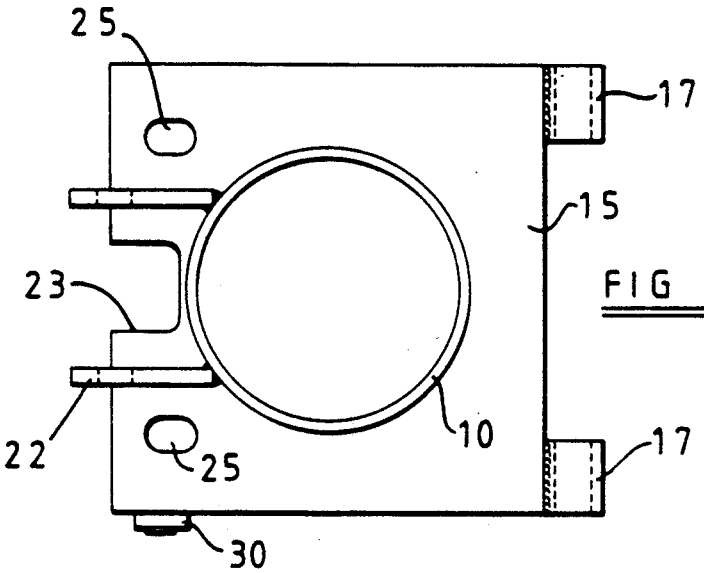
FIG. 4 is a view in the direction of arrow X in FIG. 3.

Referring now also to FIGS. 3 and 6, at its lower end the column 10 has a flat base flange 15 When the column is in its upright position, this flange lies against a flat plate 16 on the upper end of the base member 11. The flange 15 is provided with two spaced bushings 17 which receive between them a single bushing 18 on the plate 16, and the pivot is formed by a pivot pin inserted through aligned holes in these bushings. The pivot 13 lies generally in the planes of the flange 15 and of the plate 16.

As will be manifest from FIG. 2, the ram 14 is mounted upon the column in inverted configuration. A piston 19 of the ram is connected to the base member 11 by means of a pair of laterally spaced mounting lugs 20 provided on the plate 16. A cylinder 21 of the ram is similarly connected to the column 10 by means of a pair of laterally spaced mounting lugs 22 on the flange 15. In each case, the connection is made by means of a pivot rod (not shown) being passed through aligned apertures in the respective mounting lugs. As can be seen to advantage in FIG. 2, when the column 10 is in its upright position the lugs 20 and 22 are disposed at closely adjacent locations. The flange 15 has a cut-out 23 between the lugs 22, while the plate 16 similarly is recessed between the lugs 20, to allow for unimpeded operation of the ram 14 during raising and lowering of the column.

Locking means is provided to lock the column 10 in its upright position during normal useage, and comprises a pair of upstanding threaded posts 24 mounted on the plate 16 at a location remote from the pivot 13. These posts extend through respective apertures 25 in the flange 15, and are engaged by nuts 26 (see FIG. 2). The apertures 25 are made of oblong configuration to provide the necessary clearance for the posts 24 as the flange 15 tips during lowering of the column.

Figure 5:
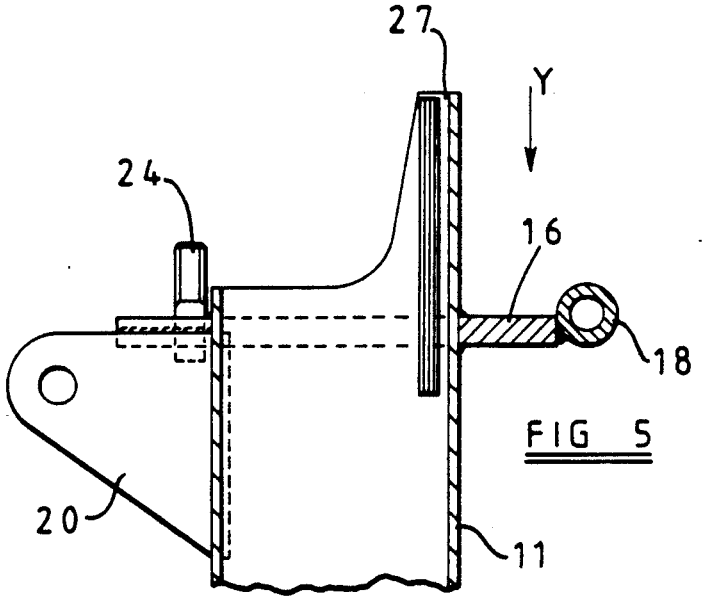
FIG. 5 is a sectional side view of an upper part of a base member which also forms part of the column unit.

Referring in particular to FIG. 5, the base member 11 is generally hollow to allow for a mains electric cable to pass therethrough for powering the appliance. Since normal mains cables are not designed to undergo repeated flexing, a terminal block (not shown) can be mounted on an upstanding projection 27 extending above the plate 16, at which the mains cable can be terminated. Another, more flexible cable can then be led from the terminal block up through the interior of the column 10 to the appliance itself. It will therefore be this other cable rather than the mains cable itself which is subjected to flexing as the column is lowered and raised.

Reference numeral 28 designates an opening in the lower part of the column 10 to allow access to the internal electrics for servicing. This opening will normally be closed by a cover (not shown).

In the illustrated embodiment, the ram 14 is not permanently connected to the column unit, but rather is attached only when the column 10 needs to be lowered In order to effect such lowering, after the ram 14 has been attached the nuts 26 are disengaged from the posts 24 to release the aforesaid locking means, whereupon power can be supplied to extend the ram and thereby push the column 10 over from its upright position Thereafter, controlled lowering of the column continues under the action of the ram. To raise the column again, these actions are reversed and the ram 14 contracts to pull the column back up into its upright position.

Figure 7:
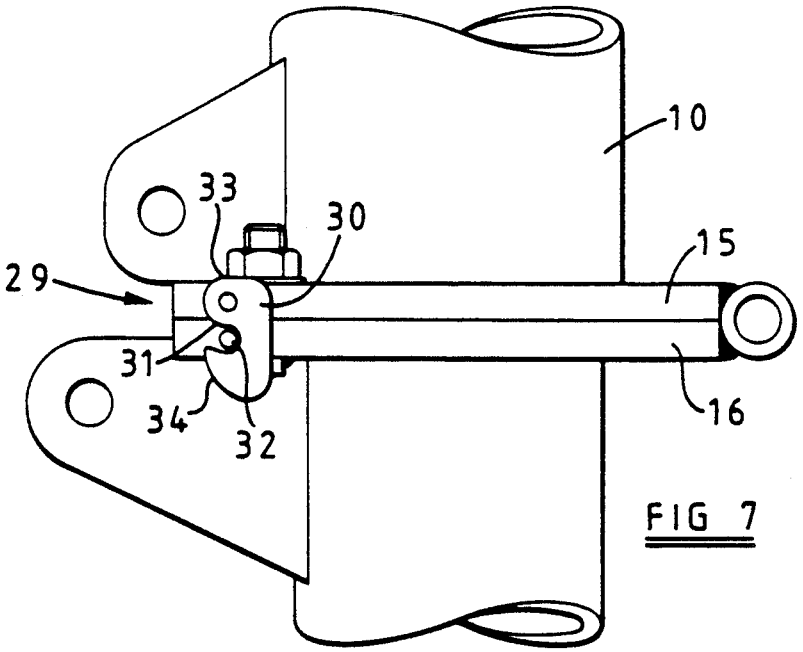
FIG. 7 is a side view of the column unit, illustrating in particular a latch device.
Figure 8:
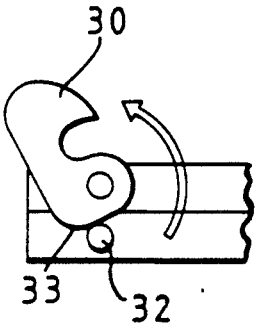
FIGS. 8 and 9 show the manner of operation of the latch device.
Figure 9:
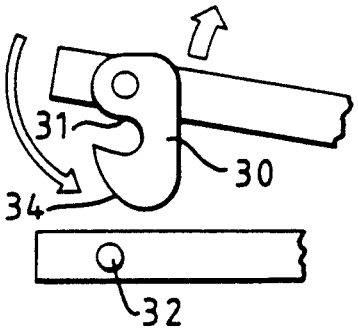

In order to prevent the column 10 from toppling over if the locking means is inadvertently released without the ram 14 connected, an interlock can be employed which retains the column in its upright position but which is readily released when the ram is connected to permit lowering of the column to commence. One example of such a safety interlock (in the form of a latch device 29) is depicted in FIG. 7, which comprises a latch member 30 pivotally mounted on the flange 15. The latch member 30 has a curved slot 31 which normally engages a pin 32 on the plate 16. Before pivotal lowering of the column can commence, the latch member 30 must be rotated about its pivot to the position shown in FIG. 8, wherein an abutment surface 33 (normally at the top of the member 30) rests against the pin 32. As the flange 15 moves away from the plate 16 during lowering of the column 10, the latch member 30 is free to pivot under gravity to the position indicated in FIG. 9. When the column 10 is subsequently raised back into its upright position, an inclined surface 34 at the bottom of the member 30 engages the pin 32 and causes the member 30 to pivot slightly to one side: when the pin 32 becomes aligned with the slot 31, the latch member 30 can then pivot back again to re-engage the latch device. Thus, the interlock is automatically re-engaged each time the column 10 is returned to its upright position.

If desired, a vandal-proof security device can be fitted to the column unit to prevent the column from being lowered by unauthorized persons. This device may conveniently take the form of a connector or link which is attached between the mounting lugs 20 and the lugs 22, and which is removed before the ram is attached.

The column unit described above provides an effective way of allowing for the appliance to be lowered e.g. for servicing at relatively modest cost. For column units which are not particularly high, the ram 14 and its associated power source can be a fairly lightweight unit which is easily managed by a single operator, thereby minimizing the personnel needed for the lowering/servicing operation. Indeed, for certain applications the power source for the ram can be hand-operated thereby reducing the overall cost even more.

Because the plate 16 is positioned close to ground level and the pivot 13 is positioned generally in the plane of the plate 16, when the column 10 is fully lowered the overall height H of the unit in the region of the base member 11 is little more than the length of the flange 15, as is illustrated in broken lines in FIG. 2. Therefore, the column unit is extremely useful in situations where lighting columns must be periodically lowered to allow for the passage of wide loads having a relatively small ground clearance. This would otherwise require the lighting columns to be totally uprooted, thereby greatly increasing the cost of the exercise.

For relatively heavy columns, the inverted mounting of the ram 14 provides an effective way of lowering the column safely, which has previously been a problem with column units incorporating a simple pivot or hinge. This is because the ram 14 extends while the column is lowered, and contracts during raising.

I claim:

1. A column unit for mounting an appliance at an elevated location with respect to ground level, comprising:

a column, a base member, a generally horizontal pivot connecting said column to said base member, said pivot being offset to one side of said column and disposed substantially at ground level, a fluid operated device connectible between said column and said base member and operative pivotally to raise and lower said column relative to said base member about said pivot, and locking means operable to lock said column relative to said base member in an upright position, whereby said fluid operated device extends as said column is pivotally lowered and contracts as the column is pivotally raised, wherein said base member includes a plate, said column includes a base flange which lies against said plate when said column is in its upright position, and said pivot interconnects said plate and said base flange.

2. A column unit according to claim 1, wherein said locking means comprises at least one security element which passage through a hole in said base flange.

3. A column unit according to claim 1, wherein said plate is disposed close to ground level, and said pivot is disposed substantially in a plane of said plate, whereby when said column is fully lowered the overall height of the column unit in the region of said base member is not substantially greater than the length of said base flange.

4. A column unit for mounting an appliance at an elevated location with respect to ground level, comprising:

a column, a base member, a generally horizontal pivot connecting said column to said base member, said pivot being offset to one side of said column and disposed substantially at ground level, a fluid operated device connectible between said column and said base member and operative pivotally to raise and lower said column relative to said base member about said pivot, and locking means operable to lock said column relative to said base member in an upright position, wherein said fluid operated device extends as said column is pivotally lowered and contracts as the column is pivotally raised, wherein said base member includes a plate, said column includes a base flange which lies against said plate when said column is in its upright position, and said pivot interconnects said plate and said base flange and wherein said fluid operated device comprises a ram having a piston and a cylinder, said base member is provided with first mounting means to which said piston of said ram is connectible, and said column is provided with second mounting means to which said cylinder of said ram is connectible, said first and second mounting means being disposed at closely adjacent locations.

5. A column unit for mounting an appliance at an elevated location with respect to ground level, comprising:

a column, a base member, a generally horizontal pivot connecting said column to said base member, said pivot being offset to one side of said column and disposed substantially at ground level, a fluid operated device connectible between said column and said base member and operative pivotally to raise and lower said column relative to said base member about said pivot, locking means operable to lock said column relative to said base member in an upright position, wherein said fluid operated device extends as said column is pivotally lowered and contracts as the column is pivotally raised, and a safety interlock which is operative to retain said column in its upright position after said locking means has been released, said safety interlock being releasable to permit said column to be pivotally lowered.

6. A column unit according to claim 5, wherein the safety interlock comprises a latch device operative automatically to re-engage when said column returns to its upright position.

7. A column unit for mounting an appliance in an elevated position comprising:

a column having an upper end and a lower end, the column carrying the appliance at the upper end of the column, a base member having an upper part for receiving the lower end of the column which is supported thereon in an upright position of use of the column;

a horizontal hinge for connecting the lower end of the column to the upper part of the base member, wherein the hinge connection is arranged to be substantially at ground level and is laterally offset in relation to the column and base member;

releasable fastening means for securing the lower end of the column in the upright position of use to the upper part of the base member;

a lug provided on each of the lower end of the column and on the upper part of the base member, the lugs being positioned on a side of the column and base member which is opposite to a side on which the hinge is disposed, the lugs being closely adjacent when the column is in the upright position of use;

a fluid pressure operated piston and cylinder ram detachably, pivotally connectible to said lugs, wherein in use the cylinder is attached to the lug on the lower end of the column and the piston is attached to the lug on the upper part of the base member such that the ram is an inverted position, whereby on release of the fastening means, extension of the ram enables controlled lowering of the column about the hinge connection with a counterbalancing action, and releasable safety interlocking latch means for latching the lower end of the column and the upper part of the base member to automatically lock the column in the upright position on being raised thereto by contraction of the ram and enabling fastening of the fastening means.

8. A column unit according to claim 7, wherein the releasable safety interlocking latch means comprises a hook-like latch member pivotally mounted about a horizontal axis on the lower end of the column and a horizontal pin on the upper part of the base member, the latch member being arranged to be swung upwardly out of engagement with the pin when it is required to lower the column about the horizontal hinge connection whereupon the latch member swings to a position depending from the lower end of the column, wherein as the lower end of the column moves away from the upper part of the base member, the latch member is positioned for automatic engagement with the pin when the column is returned to the upright position on the base member.

9. A column unit according to claim 8 wherein a portion of the latch member is formed with a curved edge for contact with the pin, wherein the curved edge pivotally deflects the latch member to one side of the pin for automatic engagement with the pin.

10. A column unit according to claim 8 wherein a portion of the latch member is adapted to rest on the pin when the latch member is swung upwardly to an inverted position out of engagement with the pin prior to lowering the column about the horizontal hinge connection, the latch member being then able to swing downwardly to the depending position as the lower end of the column is moved away from the upper part of the base member.

* * * * *